US005992379A

United States Patent [19]

Brüdigam et al.

[11] Patent Number: 5,992,379

[45] Date of Patent: Nov. 30, 1999

[54] METHOD OF CONTROLLING AN INTERNAL COMBUSTION ENGINE

[75] Inventors: Claus Brüdigam, Tegernheim; Dietmar Peters, Regensburg, both of Germany

[73] Assignee: Siemens Aktiengesellschaft, Munich, Germany

[21] Appl. No.: 09/122,054

[22] Filed: Jul. 24, 1998

[30] Foreign Application Priority Data

Jul. 24, 1997 [DE] Germany ..... 197 31 972

[51] Int. Cl.[6] ..... F02M 3/00

[52] U.S. Cl. ..... 123/339; 123/479; 123/406.13; 701/107

[58] Field of Search ..... 123/339, 479, 123/406.13; 701/107, 114

[56] References Cited

U.S. PATENT DOCUMENTS

| | | | |
|---|---|---|---|
| 5,170,769 | 12/1992 | Berger et al. | 123/399 |
| 5,235,527 | 8/1993 | Ogawa et al. | 701/114 |
| 5,235,951 | 8/1993 | Taguchi et al. | 123/399 |
| 5,247,444 | 9/1993 | Arai et al. | 701/107 |
| 5,429,092 | 7/1995 | Kamei | 123/399 |
| 5,551,396 | 9/1996 | Suzuki et al. | 123/399 |
| 5,553,581 | 9/1996 | Hirabayashi et al. | 123/399 |
| 5,746,176 | 5/1998 | Damson et al. | 123/399 |

FOREIGN PATENT DOCUMENTS

| | | |
|---|---|---|
| 34 14 588 C2 | 6/1992 | Germany . |
| 41 14 999 A1 | 11/1992 | Germany . |
| 44 38 714 A1 | 5/1996 | Germany . |
| 196 09 242 A1 | 9/1997 | Germany . |

*Primary Examiner*—John Kwon
*Attorney, Agent, or Firm*—Herbert L. Lerner; Laurence A. Greenberg

[57] ABSTRACT

A control device of the internal combustion engine has a first arithmetic unit and a second arithmetic unit. The arithmetic units process a control program with a first, second and third program level. In the second program level an actuation signal is monitored, and a first emergency operating function is activated in the first program level if the second program level has detected an implausibility of the actuation signal. The third program level is caused to carry out a second emergency operating function if, while the first emergency operating function is being carried out in the first program level, the implausibility of the actuation signal continues to be detected.

9 Claims, 3 Drawing Sheets

METHOD OF CONTROLLING AN INTERNAL COMBUSTION ENGINE

BACKGROUND OF THE INVENTION

Field of the Invention

The invention relates to a method for controlling an internal combustion engine. A sensor is provided which senses an operating parameter of the internal combustion engine and generates a measurement signal. A control device comprises first and second arithmetic units in which a control program having a first, second and third program level is processed, wherein:

the first and second program levels are processed in the first arithmetic unit, and the third program level is divided between the first and second arithmetic units;

at least one actuation signal for an actuator of the internal combustion engine is determined in the first program level as a function of the operating parameter;

the actuation signal is monitored in the second program level, and a first emergency operating function is activated in the first program level if the second program level has detected implausibility in the actuation signal; and the first arithmetic unit is monitored in the third program level and the second program level is subjected to a runtime sequence check, and a second emergency operating function is carried out if the third program level detects an error.

A method for controlling an internal combustion engine is known from German published non-prosecuted patent application DE 44 38 714 A1. There, a control device that comprises a first and second arithmetic unit is assigned to the internal combustion engine. A control program has a first, second and third program level. The first and second program levels are processed in the first arithmetic unit. The third program level is divided between the first and second arithmetic units. At least one actuation signal for an actuator of the internal combustion engine is determined in the first program level as a function of an operating parameter. An emergency operating mode in the first program level is activated in the second program level if implausibility of the actuation signal is detected.

In the third program level, memory elements are tested and there is a sequence check of the second program level. A performance limitation is implemented if the third program level has detected an error.

If an emergency operating mode in the first program level is initiated by the second program level, the emergency operation is possibly in fact not carried out, or only carried out in an incorrect way. This is a high risk for the driving safety of a motor vehicle with the control device if the performance of the internal combustion engine is influenced by the actuator, since the third program level only monitors the second program level.

Furthermore, the disclosure DE 44 38 714 that a fault state which has been detected leads to a performance limitation by means of the third program level. However, in practice, the third program level has only little, or even no, information on the current values of the operating parameters. Accordingly, the performance limitation can then only be implemented by deactivating the internal combustion engine. However, this means a considerable loss in driving convenience and can result in an unnecessarily low reliability of the control device.

SUMMARY OF THE INVENTION

It is accordingly an object of the invention to provide a method of controlling an internal combustion engine, which overcomes the above-mentioned disadvantages of the prior art devices and methods of this general type and which controls the internal combustion engine in such a way that safe and reliable operation of the internal combustion engine is ensured with a simultaneously high level of driving convenience.

With the foregoing and other objects in view there is provided, in accordance with the invention, a method of controlling an internal combustion engine, which comprises:

providing a sensor and sensing therewith an operating parameter of an internal combustion engine and generating a measurement signal;

providing a control device with a first arithmetic unit and a second arithmetic unit for processing therein a control program having a first program level, a second program level, and a third program level;

processing the first and second program levels in the first arithmetic unit, and dividing the third program level between the first and second arithmetic units;

determining an actuation signal for an actuator of the internal combustion engine in the first program level in dependence on the operating parameter of the internal combustion engine;

monitoring the actuation signal in the second program level, and activating a first emergency operating function in the first program level if the second program level detects an implausibility in the actuation signal;

monitoring the first arithmetic unit in the third program level, and subjecting the second program level to a program sequence check, and carrying out a second emergency operating function if the third program level detects an error; and with the second program level, causing the third program level to carry out the second emergency operating function if, assuming that the first emergency operating function is being carried out in the first program level, the implausibility of the actuation signal continues to be detected.

In accordance with an added feature of the invention, the first emergency operating function in the first program level is actuated with the second program level if the second program level detects an implausibility in the measurement signal.

In accordance with another feature of the invention, the second program level detects an actual torque as a function of the actuation signal, determines a requested torque as a function of the measurement signal and of external torque requests, and actuates the first emergency operating function in the first program level if the second program level detects an implausibility between the actual torque and the requested torque; and the second program level causes the third program level to carry out the second emergency operating function if, while the first emergency operating function is being carried out in the first program level, the implausibility between the actual torque and the requested torque continues to be detected.

In accordance with an additional feature of the invention, the second program level causes the third program level to carry out the second emergency operating function if the implausibility is detected for longer than a prescribed time period.

In accordance with again an added feature of the invention, the first emergency operating function is a limitation of a rotational speed of the internal combustion engine, and the second emergency operating function is a deactivation of the internal combustion engine.

In accordance with again another feature of the invention, a check variable is defined and, at prescribed program points in the second program level, a value of the check variable is changed in a prescribed manner. The value of the check variable is additionally changed if, assuming that the first emergency operating function in the first program level is being carried out, the implausibility of the actuation signal or between the actual torque and the requested torque is detected, and the program sequence check is performed in dependence on the check variable.

In accordance with a concomitant feature of the invention, the actuator for which the program provides an actuation signal is a throttle valve of the internal combustion engine.

Other features which are considered as characteristic for the invention are set forth in the appended claims.

Although the invention is illustrated and described herein as embodied in a method for controlling an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
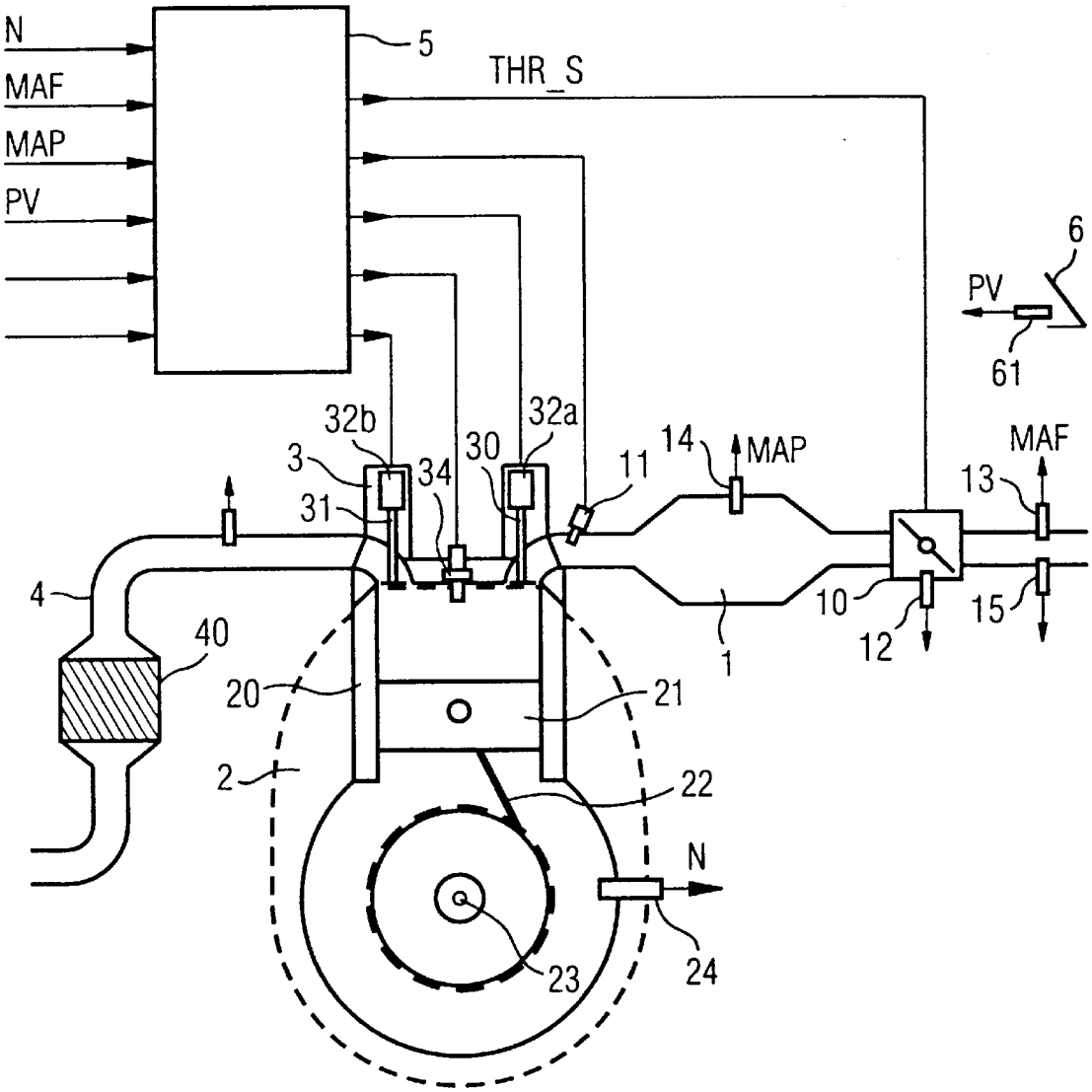
FIG. 1 is a schematic view of an internal combustion engine with a control device.

Reference is now had in detail to the figures of the drawing, wherein elements with mutually identical structure and function are referenced with identical reference symbols throughout. There is shown, in FIG. 1, an internal combustion engine (ICE) which comprises an intake tract 1 with a throttle valve 10 and an engine block 2, which has a cylinder 20 and a crankshaft 23. A piston 21 and a connecting rod 22 are disposed in the cylinder 20. The connecting rod 22 is connected to the piston 21 and to the crankshaft 23.

A cylinder head 3 is provided in which there are arranged a valve drive with at least one intake valve 30, one exhaust valve 31. A valve drive 32*a* operates on the intake valve 30, and a valve drive 32*b* operates on the exhaust valve. The valve drives 32*a*, 32*b* each comprise a non-illustrated camshaft with a transmission device which transmits the cam lift to the intake valve 30 or the exhaust valve 31. There may also be provision of devices for adjusting the valve stroke times and the valve stroke profile. Alternatively, there may also be provision in each case of an electromagnetic actuator which controls the valve stroke profile of the intake valve 30 and exhaust valve 31, respectively.

An injection valve 11 is arranged in the intake tract 1 in such a way that the fuel is metered into the intake tract 1. However, the injection valve can alternatively also be provided in the cylinder head 3 and disposed there in such a way that the fuel is directly metered into the interior combustion chamber of the cylinder 20.

A spark plug 34 is provided in an opening of the cylinder head 3. The internal combustion engine may also be embodied as an auto-ignition internal combustion engine. In that case, of course, no spark plug 34 would be necessary. If appropriate, an injection nozzle is provided instead of the injection valve. The internal combustion engine is illustrated in FIG. 1 with one cylinder. It will be readily understood, however, that the engine may have a plurality of cylinders.

An exhaust tract 4 with a catalytic converter 40 communicates with the internal combustion engine.

A control device 5 is provided for the internal combustion engine. The control device is assigned sensors which sense various measurement parameters, determine in each case the measured value of the measurement parameter and generate a measurement signal. The control device 5 determines, as a function of at least one operating parameter, one or more actuation signals which each control an actuator unit.

The illustrated sensors include a pedal position sensor 61, which senses a pedal value PV of the accelerator pedal 6; a throttle valve position sensor 12, which senses a degree of opening of the throttle valve 10; an air flow rate or air mass meter 13, which senses an air mass flow MAF, and/or an intake manifold pressure sensor 14, which senses an intake manifold pressure MAP in the intake tract 1; a temperature sensor 15, which senses an intake air temperature; and a rotational speed sensor 24, which senses a rotational speed N of the crankshaft 23, also referred to as the speed N of the engine. The control device 5 may be any desired subset of the aforesaid sensors or additional sensors may also be assigned to it.

Operating parameters comprise the measured value and values derived therefrom, such as those for an ambient pressure, which are determined by means of a characteristic diagram relationship or by an observer which calculates estimated values of the operating parameters.

The actuator units each comprise an actuator drive and an actuator. The actuator drive is an electromotive drive, an electromagnetic drive, a mechanical drive or some other drive known to those of skill in the automotive arts. The actuators are embodied as a throttle valve 10, an injection valve 11, a spark plug 34 or an adjustment device for adjusting the valve stroke of the inlet or exhaust valves 30, 31. Below, reference is made to the actuator units in each case with the assigned actuator.

The control device of the preferred embodiment is an electronic engine controller. However, it may also comprise a plurality of control units which are electrically connected to one another, via a bus system, for example.

Figure 2:
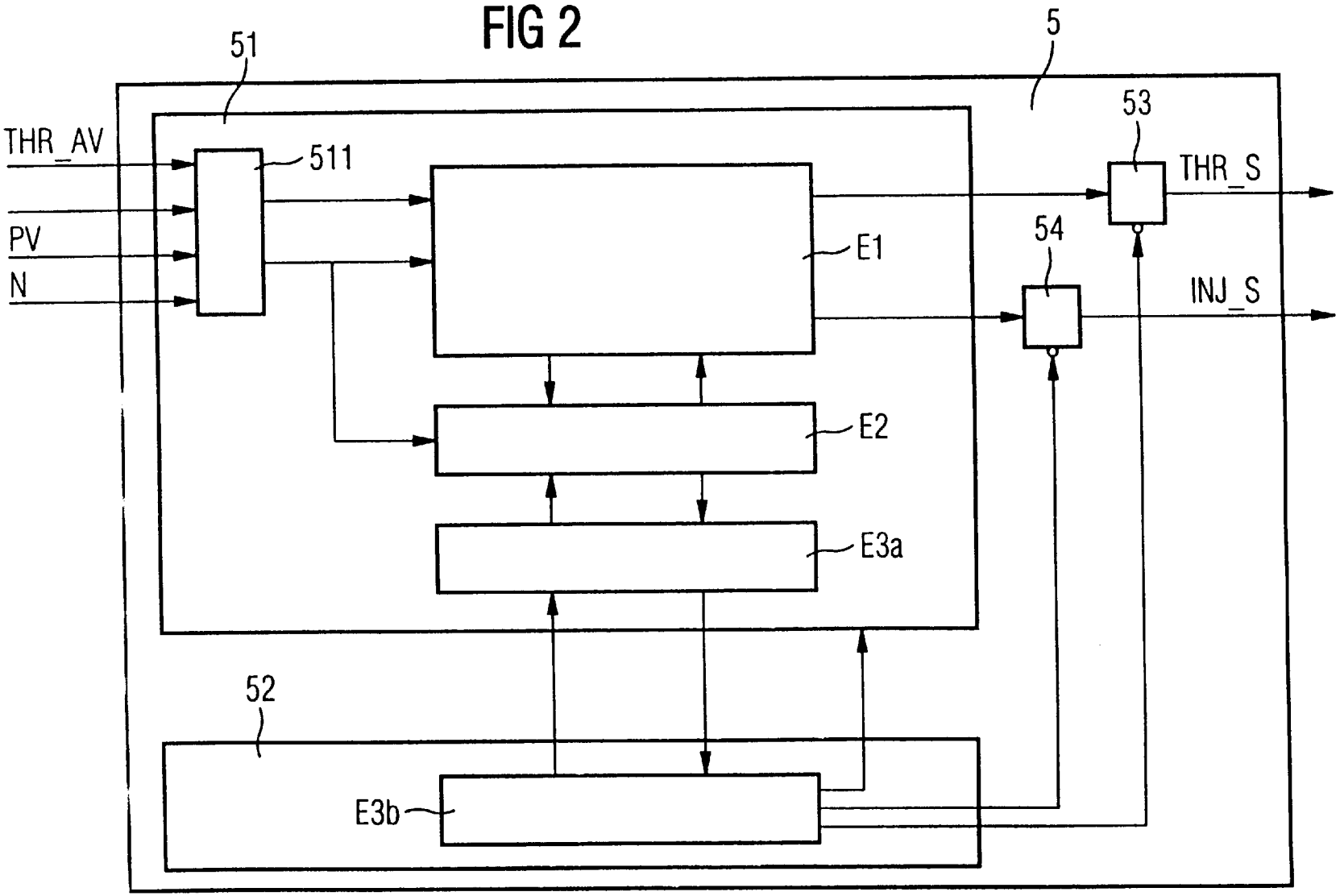
FIG. 2 is a block diagram of the control device.

Reference is now had to the block diagram of FIG. 2: There, the control device 5 has a first arithmetic unit 51 and a second arithmetic unit 52 in which a control program with a first, second and third program level E1, E2, E3 is processed. The first arithmetic unit is assigned an analog-digital-converter 511 which digitizes the measurement signals.

The first and second program levels are processed in the first arithmetic unit 51. The third program level E3*a*, E3*b* is divided between the first and second arithmetic units 51, 52. Actuation signals for the throttle valve 10, the injection valve 11 and the spark plug 34, and preferably for the other actuators are determined in the first program level E1 as a function of the operating parameters. In addition, diagnostic functions, such as a diagnosis of the pedal position sensor, for example, are processed in the first program level. The actuation signals are fed to output stages 53, 54 which each amplify an actuation signal.

In the second program level, the actuation signals are monitored and a first emergency operating function NL1 in the first program level E1 is activated if the second program level E2 has detected implausibility in one of the actuation signals, in one of the measurement signals or between an actual torque and a requested torque. The actual torque is determined as a function of at least one actuation signal, preferably as a function of an ignition signal (ignition angle) and of the injection time period or else as a function of the ignition signal and the rotational speed N measurement signals and air flow rate measurement signals. The requested torque is determined from a torque loss element, which depends on the air flow rate, the rotational speed N and/or a coolant temperature, from a desired torque, which depends on the accelerator pedal value PV, from external torque requests, such as a traction controller, for example, an idling controller, an engine torque controller or a speed controller, and by taking into consideration whether or not the first emergency operating function should be activated.

The first emergency operating function NL1 is preferably a limitation of the rotational speed in order to control an internal combustion engine. This ensures comfortable emergency operation in which a driver of a vehicle in which the internal combustion engine is disposed can safely drive her vehicle to a workshop. The second program level E2 will be explained in detail below with reference to FIG. 3.

The third program level E3*a,* E3*b* is divided between the first and second arithmetic units 52. The part of the program level E3*b* which is processed in the second arithmetic unit 52 is referred to below as a watch-dog. The third program level E3*a,* E3*b* monitors the first arithmetic unit 51. For this purpose, it tests the memory elements of the first arithmetic unit 51. In addition, it periodically calls functions which carry out arithmetic commands in the first arithmetic unit 51, and monitors their execution. A sequence check of the second program level E2 is carried out in the third program level E3. For this purpose, the current value of a check variable KV is compared with a prescribed value, in each case after a prescribed time period.

The value of the check variable is changed at prescribed program points in the second program level E2. The prescribed value of the check variable is that value which the check variable has if the software functions of the second program level are being processed free of errors during the prescribed time period.

If the third program level E3 detects that the value of the check variable deviates from the prescribed value, then it activates a second emergency operating function. The second emergency operating function—in the best mode embodiment—is a deactivation of the internal combustion engine. For this purpose, the output stages 53 and 54 are deactivated. The result of this is that the actuation signal THRS for the degree of opening of the throttle valve 10, and the injection signal INJS for the injection valve 11, are no longer amplified and the air flow rate MAF is thus reduced and fuel is not metered anymore.

The second arithmetic unit is preferably implemented as a cost-effective micro-controller.

Figure 3:
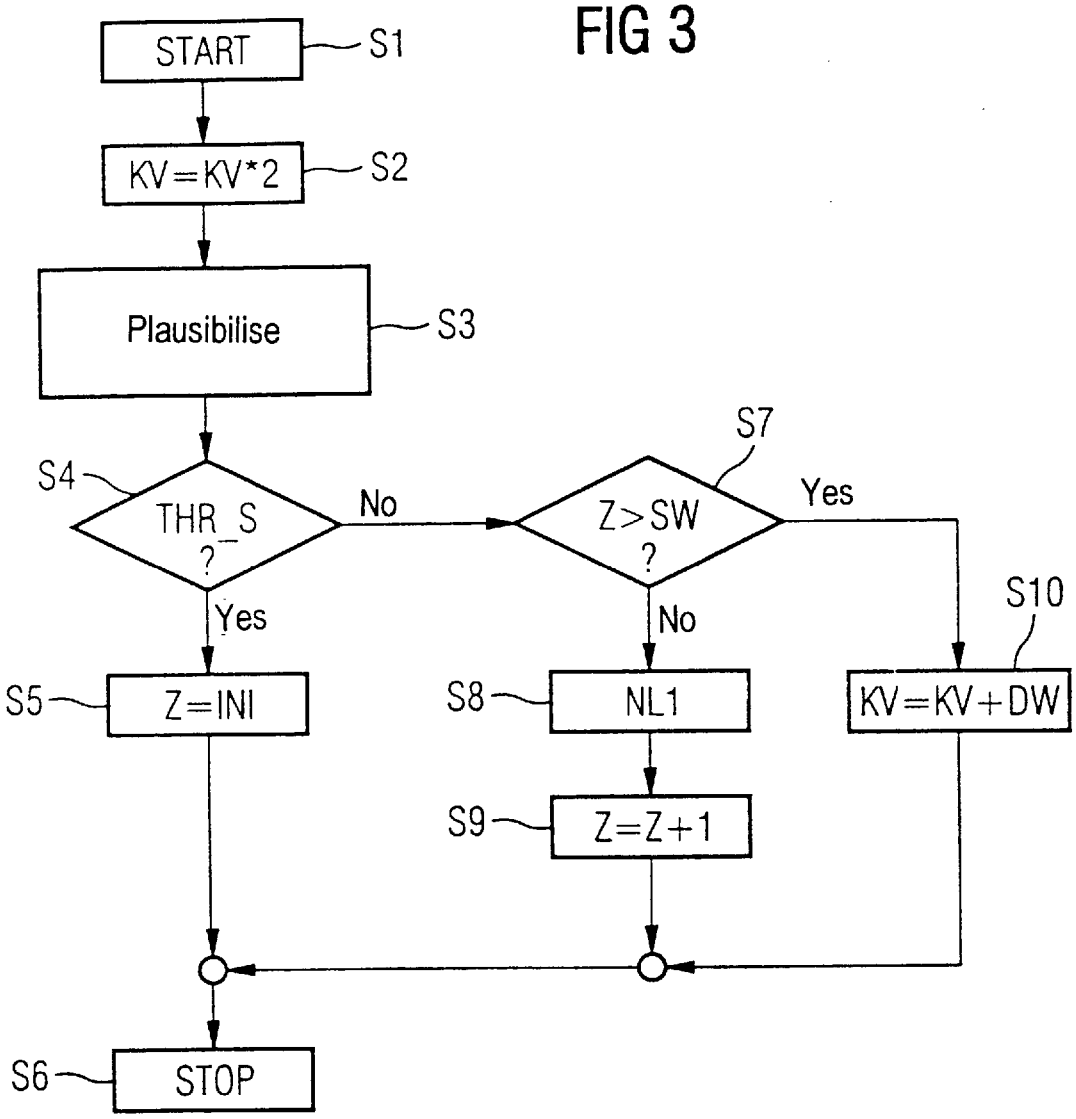
FIG. 3 is a flowchart of a control program in a second program level.

FIG. 3 shows a flowchart of the second program level E2 of the control program. The program is started in a step S1, during which the current value of the check variable KV and of a counter Z are read out of a memory. In a step S2, the value of the check variable KV is changed. The check variable KV is multiplied by two. However, the value of the check variable KV can also be changed with any other desired prescribed arithmetic operation. The value of the check variable KV is also changed at further prescribed program points in the second program level E2.

The program level E3 detects, with reference to the value of the check variable KV, whether all such program points have been correctly processed, and thus concludes whether the second program level E2 is operating correctly or incorrectly.

In a step S3, the measurement signals and/or the actuation signals which have been determined in the first program level E1 are subjected to a plausibility check. This is done, for example, within the framework of torque monitoring. The torque requested by the first program level E1 at a shaft of the drive train, for example the crankshaft, is compared with the actual torque which is determined by the second program level E2. If the torques deviate from one another by more than a prescribed threshold value, then the presence of an error in the first program level E2 is concluded. Moreover, in the second program level there may also be plausibility checking of the pedal position sensor 61, which is preferably a dual channel sensor.

The program queries, in a step S4, whether an error in the first program level E1 has been detected in the step S3. If the first program level E1 is free of faults, then the program branches into a step S5 in which the counter Z is assigned an initialization value INI and the processing is terminated at step S6. However, if a fault has been detected in step S3, then the process continues after the step S4 in step S7, which checks whether the counter Z has a value that is greater than the second threshold value SW. If this is not the case, then in a step S8, the first program level E1 is made to carry out the first emergency operating function NL1.

In a step S9, the counter Z is incremented by one or by any other desired value.

If the condition of the step S7 is fulfilled, then the check variable KV is increased in a step S10 by the change value DW. The result of this is that the value of the check variable KV does not have the prescribed value when evaluation by the third program level E3 takes place, and the second emergency operating function is thus carried out. This has the advantage that, without an additional data line, the program level E3 can be made to carry out the second emergency operating function, and the second emergency operating function is carried out only if the first emergency operating function is not activated despite a plurality of requests by the second program level E2.

However, it will be understood that, as an alternative, there may also be provision of a separate data line via which the third program level E3 is made to carry out the second emergency operating function.

The invention is not restricted to the exemplary embodiments described. For example, as an alternative, the second program level may also deactivate the output stage 53, and only the output stage 54 can, alone, be deactivated by the third program level. The first emergency operating function can, as an alternative, be a speed limitation or an acceleration limitation. The second emergency operating function may also comprise a deactivation of the first arithmetic unit.

We claim:

1. A method of controlling an internal combustion engine, which comprises:

providing a sensor and sensing therewith an operating parameter of an internal combustion engine and generating a measurement signal;

providing a control device with a first arithmetic unit and a second arithmetic unit for processing therein a control program having a first program level, a second program level, and a third program level;

processing the first and second program levels in the first arithmetic unit, and dividing the third program level between the first and second arithmetic units;

determining an actuation signal for an actuator of the internal combustion engine in the first program level in dependence on the operating parameter of the internal combustion engine;

monitoring the actuation signal in the second program level, and activating a first emergency operating function in the first program level if the second program level detects an implausibility in the actuation signal;

monitoring the first arithmetic unit in the third program level, and subjecting the second program level to a program sequence check, and carrying out a second emergency operating function if the third program level detects an error; and with the second program level, causing the third program level to carry out the second emergency operating function if, assuming that the first emergency operating function is being carried out in the first program level, the implausibility of the actuation signal continues to be detected.

2. The method according to claim 1, which comprises actuating the first emergency operating function in the first program level with the second program level if the second program level detects an implausibility in the measurement signal.

3. The method according to claim 1, which further comprises:

determining, in the second program level, an actual torque as a function of the actuation signal, and determining a requested torque as a function of the measurement signal and of external torque requests, and actuating the first emergency operating function in the first program level if the second program level detects an implausibility between the actual torque and the requested torque; and with the second program level, causing the third program level to carry out the second emergency operating function if, assuming that the first emergency operating function is being carried out in the first program level, the implausibility between the actual torque and the requested torque continues to be detected.

4. The method according to claim 1, which comprises, with the second program level, causing the third program level to carry out the second emergency operating function if the implausibility is detected for longer than a prescribed time period.

5. The method according to claim 1, which comprises defining the first emergency operating function as a limitation of a rotational speed of the internal combustion engine.

6. The method according to claim 1, which comprises defining the second emergency operating function as a deactivation of the internal combustion engine.

7. The method according to claim 3, which further comprises defining a check variable and, at prescribed program points in the second program level, changing a value of the check variable in a prescribed manner, and additionally changing the value of the check variable if, assuming that the first emergency operating function in the first program level is being carried out, the implausibility of the actuation signal or between the actual torque and the requested torque is detected, and performing the program sequence check in dependence on the check variable.

8. The method according to claim 1, which further comprises defining a check variable and, at prescribed program points in the second program level, changing a value of the check variable in a prescribed manner, and additionally changing the value of the check variable if, assuming that the first emergency operating function in the first program level is being carried out or the implausibility of the actuation signal is detected, and performing the program sequence check in dependence on the check variable.

9. The method according to claim 1, wherein the actuator is a throttle valve of the internal combustion engine.

* * * * *